US008590142B2

(12) United States Patent
Tanaka et al.

(10) Patent No.: US 8,590,142 B2
(45) Date of Patent: Nov. 26, 2013

(54) PROCESS FOR PRODUCING PTC DEVICE

(76) Inventors: Arata Tanaka, Ryugasaki (JP); Katsuaki Suzuki, Ruygasaki (JP)

( * ) Notice: Subject to any disclaimer, the term of this patent is extended or adjusted under 35 U.S.C. 154(b) by 1156 days.

(21) Appl. No.: 12/086,311

(22) PCT Filed: Dec. 7, 2006

(86) PCT No.: PCT/JP2006/324456
§ 371 (c)(1),
(2), (4) Date: Apr. 29, 2009

(87) PCT Pub. No.: WO2007/066725
PCT Pub. Date: Jun. 14, 2007

(65) Prior Publication Data

US 2009/0223035 A1 Sep. 10, 2009

(30) Foreign Application Priority Data

Dec. 9, 2005 (JP) ..... 2005-356125

(51) Int. Cl.
*H01H 69/02* (2006.01)

(52) U.S. Cl.
USPC ..... 29/623; 439/620.26; 29/860

(58) Field of Classification Search
USPC ..... 29/623, 860; 439/620.26
See application file for complete search history.

(56) References Cited

U.S. PATENT DOCUMENTS 4,314,231 A * 2/1982 Walty ..... 338/328
6,317,248 B1 * 11/2001 Agrawal et al. ..... 359/265

FOREIGN PATENT DOCUMENTS

| | | | |
|---|---|---|---|
| JP | 10-199706 | A | 7/1998 |
| JP | 10-208902 | A | 8/1998 |
| JP | 2000-216002 | A | 8/2000 |
| JP | 2001-15303 | A | 1/2001 |
| JP | 2001-102039 | A | 4/2001 |
| JP | 2001-511598 | A | 8/2001 |
| JP | 2001-307904 | A | 11/2001 |
| JP | 2005-521256 | A | 7/2005 |
| JP | 2006-525680 | A | 11/2006 |

OTHER PUBLICATIONS

International Search Report for International Application No. PCT/JP2006/324456, mailed Mar. 13, 2007.

* cited by examiner

*Primary Examiner* — Peter DungBa Vo
*Assistant Examiner* — Jeffrey T Carley

(57) ABSTRACT

There is provided a polymer PTC device including a polymer PTC element having a lower resistance. The production process of a PTC device which includes a PTC element (102) having a polymer PTC component (110) and metal electrodes (104) placed on both sides thereto; and a lead (106) connected electrically to at least one of the metal electrodes, is characterized in that the polymer PTC component is formed of an electrically conductive polymer composition which comprises a polymer material and conductive fillers dispersed therein, and the connection of the lead to the metal electrode is performed at a temperature which is lower than the melting point of the polymer material.

5 Claims, 3 Drawing Sheets

PROCESS FOR PRODUCING PTC DEVICE

FIELD OF THE INVENTION

The present invention relates to a process of producing a polymer PTC device, and a polymer PTC device produced by such a production process.

BACKGROUND ART

A polymer PTC element which comprises a polymer PTC component formed, for example, in a laminar form from a conductive polymer material comprising a polymer material and conductive fillers contained therein, and metal electrodes placed on both sides of the polymer PTC component is widely used in electrical or electronic apparatuses.

Such a polymer PTC element is used in an electronic apparatus as, for example, a circuit protection device. It has substantially no resistance when the apparatus is in normal use. However, when the apparatus is in an abnormal state or when the environment around the apparatus is in an abnormal state, the temperature of the polymer PTC element itself becomes high, and the resistance of the element increases rapidly so as to cause a so-called trip, and thereby the element acts to prevent destruction of the apparatus beforehand by cutting off a current flowing through the apparatus. When the apparatus is functioning normally, such a polymer PTC element preferably has as low a resistance as possible as if the element were absent.

When using a polymer PTC element in an electronic apparatus, a polymer PTC element having metal electrodes connected to a polymer PTC component is obtained, then a PTC device having a lead electrically connected to at least one of the metal electrodes is obtained, and such PTC device is connected to a prescribed wiring or an electric component, so that the polymer PTC component is inserted into a prescribed circuit of the electronic apparatus via the lead.

The polymer PTC device comprising a lead is produced by affixing by thermal compression, for example, metal foils as metal electrodes on a top surface and a bottom surface of an electrically conductive polymer material extruded, for example, in a sheet form, cutting or punching out it into a prescribed size, then connecting various types of leads to the metal electrodes in order to insert the polymer PTC device in a circuit of an electronic apparatus. For example, in Japanese Patent Kokai Publication No. 2001-102039 , solder connection, resistance connection and the like are used to for the connection of the lead.

SUMMARY OF THE INVENTION

Such a polymer PTC element preferably has as low a resistance as possible when the apparatus is functioning normally, as if the element did not exist. When the temperature of the ambient in which the polymer PTC element is placed rises, the resistance of the element rises gradually to just under its trip temperature, and then increases rapidly. Obviously, it is desirable that the resistance itself of the polymer PTC element be inherently low. Therefore, it is desired that a polymer PTC device is provided which comprises a polymer PTC element of which resistance is lower.

It has been found that the above problem is solved by a process of producing a PTC device comprising a polymer PTC element which comprised a polymer PTC component and metal electrodes placed on both sides thereto; and a lead electrically connected to at least one of the metal electrodes, wherein the polymer PTC component is formed of an electrically conductive polymer composition comprising a polymer material with an electrically conductive filler dispersed therein, and the connection of the lead to the metal electrode is performed at a temperature which is lower than a melting point of the polymer material.

In the process of producing the PTC device according to the present invention, the individual components of the PTC component and the metal electrodes which constitute the PTC element as well as the lead may be the same as those used in conventional PTC devices, and since these are known, detailed explanations thereof are omitted.

The polymer material constituting the polymer PTC component is preferably a crystalline polymer or a polymer composition containing the crystalline polymer. For example, a polyethylene (PE), a polyvinylidene fluoride (PVDF), an ethylene-butyl acrylate copolymer (EBA), an ethylene-vinyl acetate copolymer (EVA) may be given as examples of such crystalline polymer. It is noted that as the electrically conductive filler dispersed in such polymer material, carbon black, a nickel filler, a nickel alloy (e.g. nickel-cobalt alloy) filler and the like may, for example, be used.

The metal electrode of the PTC element is a metal foil, in particular a nickel foil. In another preferred embodiment, the lead connected to the PTC element is made of nickel.

It is noted that in the present specification, the melting point of the polymer which constitutes the polymer PTC element means a temperature measured by a DSC based on JIS K 7121 (Process of Measuring the Transition Temperature of Plastics) (a temperature at the apex of the peak) applied to measure the crystalline transition temperature of plastics. The key measuring conditions are as follows:

Temperature condition: 20-180° C.

Temperature increasing rate: 10° C./min

Measuring atmosphere: nitrogen

Equipment: EXSTAR6000/6200 (Seiko Instruments Inc.)

The production process according to the present invention is characterized by implementing the connection of the lead to the metal electrode at a temperature that is lower than the melting point of the polymer material. Specifically, this connection may be implemented as connection with an electrically conductive adhesive, connection with a solder paste, connection with a solder material (so-called soldering which optionally uses a flux and the like) or the like as long as upon such connection, the PTC element, in particular its conductive polymer component is not subjected to a temperature which is equal to or above the melting point of the polymer constituting the element or the component.

A rough indication of whether or not there is exposure to a temperature equal to or above the melting point of the polymer is the temperature applied when connecting, and for example in the case of an electrically conductive adhesive or a solder paste, the temperature required to cure a curable resin contained therein, and in the case of soldering, the temperature required to melt the solder material (the melting point of the solder material). In other words, since heating has to be equal to or above such required temperature during the connection, the polymer and the electrically conductive adhesive, the solder paste, or the solder material are selected so that the required temperature is lower than the melting point of the polymer, preferably by least 10° C., more preferably at least 20° C., in particular preferably at least 30° C. lower.

The production process according to the present invention provides a PTC device with a lower resistance of the PTC element (that is, in an untripped normal condition). Thus, the PTC device produced through such a process is more useful compared with the conventional PTC devices. Also, in the production process of the conventional PTC devices, since the lead is connected to the PTC element at a temperature higher than the melting point of the polymer material, the resistance of the PTC element increases, so that a thermocycle needs to be applied wherein the PTC device is heated and cooled for example between 0° C. and 160° C. so as to perform a resistance stabilization treatment thereby to lower and stabilize the resistance of the PTC element in the PTC device. However, in the production process of the present invention, the resistance is not substantially increase, so such resistance stabilization treatment may be omitted.

It is noted that the stabilization treatment is normally a treatment to stabilize the resistance of the PTC device (strictly speaking, the PTC element) by subjecting the device to a so-called heat cycling wherein the device is heated normally to a temperature not exceeding the melting point of the polymer constituting the PTC element, and cooled normally close to room temperature or lower, and then being heated/cooled again. In such stabilization treatment, an impulse treatment described below (a treatment whereby the PTC element is tripped through a short term application of voltage) may also be included.

EXPLANATION OF THE LEGENDS

100—PTC device
102—PTC element
104—metal electrode
106—lead
108—connection portion
110—polymer PTC component
112—main surface of polymer PTC component

DETAILED DESCRIPTION OF THE INVENTION

Figure 1:
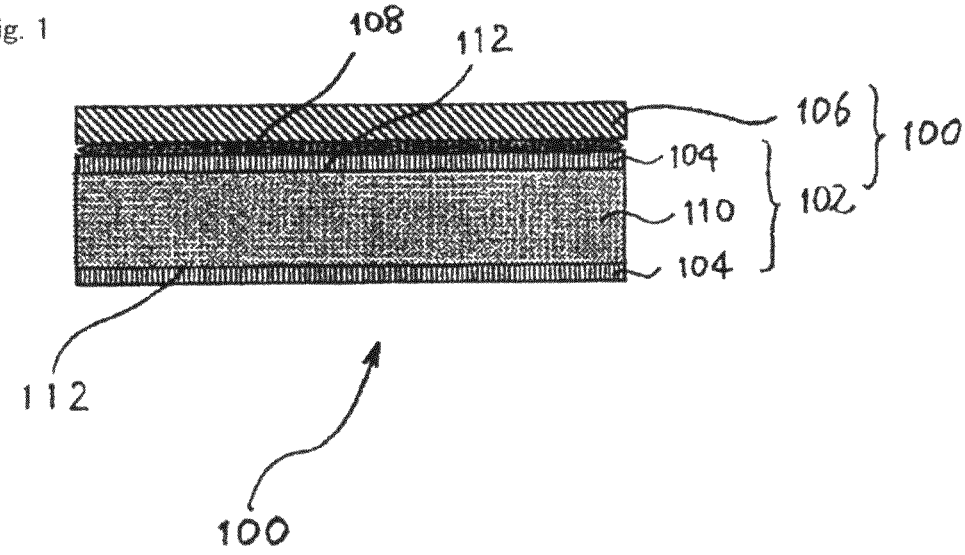
FIG. 1 schematically shows a polymer PTC device according to the present invention as a side cross-sectional view so that constituent members of the device may be understood.

In FIG. 1, the polymer PTC device according to the present invention is schematically shown in a side cross-sectional view so that the constituent members of the device may be understood. The illustrated PTC device 100 comprises a PTC element 102 and a lead 106 connected to a metal electrode 104 of the device. The lead 106 is electrically connected to the metal electrode 104 via a connection portion 108. In the illustrated embodiment, there is the connection portion 108 between the metal electrode 104 and the lead 106 which are electrically connected by the portion 108. This connection portion 108 is composed of an electrically conductive adhesive (generally a mixture of a curable resin (hardening or curing resin), in particular a thermosetting resin and metal fillers) cured at a temperature lower than the melting point of the polymer material. Solder paste (generally a mixture of a curable resin, in particular a thermosetting resin and solder particles) may be used in place of the conductive adhesive.

It is noted that the PTC element 102 comprises a polymer PTC component 110 and a metal electrode 104 placed on at least one surface of the component, for example metal electrodes 104 on both main surfaces 112 of a laminar polymer PTC component 110 as shown. The polymer PTC component 110 is composed of a polymer material and conductive fillers dispersed therein.

In the process of producing a PTC device according to the present invention, the electrical connection of the lead 106 to the polymer PTC device 102 is performed at a temperature lower than the melting point of the polymer material. More specifically, when the connection is performed using an electrically conductive adhesive or solder paste, an electrically conductive adhesive or solder paste is selected in which a curing temperature of the curable resin contained therein is lower than the melting point of the polymer material. A thermosetting resin, a moisture curable resin, and a radiation (e.g. UV rays) curable resin may be given as examples of such curable resins.

If the curable resin is a thermosetting resin, the selected electrically conductive adhesive or solder paste is supplied on the electrode of the PTC element, and a lead is placed thereon, followed by heating as they are. A heating furnace such as an oven may be used for the heating. Such supply may be performed by coating the electrically conductive adhesive or solder paste, or placing a mass of the electrically conductive adhesive or solder paste with a dispenser.

An embodiment of a local heating is possible wherein only the lead is heated, but the PTC element and the lead placed thereon are preferably heated as a whole. When the curing resin is cured through an effect other than heat, the curing proceeds in a room temperature or slightly heated temperature condition, so that the electrical connection can be performed at a temperature lower than the melting point of the polymer material.

As described in the foregoing, the resistance of the PTC element in the PTC device obtained through the production process according to the present invention is lower than the resistance of the PTC element in the PTC device produced by the conventional production process, as a result of which the resistance stabilization treatment process may be omitted as described above. Thus, the present invention provides a new process of producing a PTC device, and after producing the PTC device by connecting the lead to the metal electrode of the PTC element in accordance with the process of the invention as described above, the resistance stabilization treatment process need not be performed. Thus, the PTC device is completed as a product after connecting the lead in accordance with the process of producing the PTC device as described above.

EXAMPLE 1

Producing PTC Device 1

A PTC device was produced by using the following PTC element, lead, and electrically conductive adhesive, and electrically connecting the lead to the PTC element by means of the electrically conductive adhesive.

PTC element:

PTC chip for LR4-260 (produced by Tyco Electronics Raychem, size: 5 mm×12 mm; polymer material: high density polyethylene (melting point: approximately 137° C.); conductive filler: carbon black; metal electrode: nickel foil with exposed surface gold plated)

This chip was not subjected to impulse treatment described below or resistance stabilization treatment.

Lead:

Gold-plated nickel lead

Electrically Conductive adhesive (produced by Fujikura Chemical K.K.; trade name: DOTITE XA-910):

electrically conductive filler/silver particle; binder/1-part epoxy resin curing conditions: 100° C., 60 minutes The electrically conductive adhesive was supplied with a dispenser to one of the metal electrodes of the PTC element and the lead was placed on the adhesive; and the assembly was retained for 60 minutes in a constant temperature vessel with the temperature set at 100° C., after which it was taken out of the constant temperature vessel and cooled so as to produce PTC Device 1 having the lead electrically connected to the PTC element. For comparison, a Comparative PTC Device 1 was produced as Comparative Example 1 by using a solder paste instead of the electrically conductive adhesive, connecting the lead to the PTC element by soldering in a reflow oven (250-260° C.).

EXAMPLE 2

Producing PTC Device 2

A PTC device was produced using the following PTC element, lead, and conductive adhesive, and electrically connecting the lead to the PTC element using the conductive adhesive.

PTC Element:

PTC chip for TD1120-B14-0 (produced by Tyco Electronics Raychem, size: 11 mm×20 mm; polymer material: high density polyethylene (melting point: approximately 137° C.); conductive filler: carbon black; metal electrode: nickel foil with exposed surface copper plated)

This chip was not subjected to impulse treatment described below or resistance stabilization treatment.

Lead:

Brass lead

Electrically Conductive adhesive (produced by Fujikura Chemical K.K.; trade name: DOTITE XA-910):

electrically conductive filler/silver particle; binder/1-part epoxy resin;

curing conditions: 100° C., 60 minutes

The electrically conductive adhesive was supplied with a dispenser to one of the metal electrodes of the PTC element and the lead was placed on the adhesive; and the assembly was retained for 60 minutes in a constant temperature vessel with the temperature set at 100° C., after which it was taken out of the constant temperature vessel and cooled so as to produce PTC Device 2 having the lead electrically connected to the PTC element. For comparison, a Comparative PTC Device 2 was produced as Comparative Example 2 by using a solder paste instead of the electrically conductive adhesive, connecting the lead to the PTC element by soldering in a reflow oven (250-260° C.).

EXAMPLE 3

Producing PTC Device 3

A PTC device was produced using the following PTC element, lead, and conductive adhesive, and electrically connecting the lead to the PTC element using the conductive adhesive.

PTC element:

TD1115-B34XA-0 PTC chip (produced by Tyco Electronics Raychem, size: 11 mm×15 mm; polymer material: polyvinylidene fluoride (approximately 177° C.); conductive filler: carbon black; metal electrode: nickel plated copper foil with exposed surface copper plated)

This chip was not subjected to impulse treatment described below or resistance stabilization treatment.

Lead:

Brass lead

Electrically Conductive adhesive (produced by Fujikura Chemical K.K.; trade name: DOTITE XA-874):

electrically conductive filler/silver particle; binder/1-part epoxy resin;

curing conditions: 150° C., 30 minutes

The conductive adhesive was supplied with a dispenser to one of the metal electrodes of the PTC element and a lead placed over it; the assembly was retained for 30 minutes in a constant temperature vessel with the temperature set at 150° C., after which it was taken out of the vessel oven and cooled so as to produce PTC Device 3 having a lead electrically connected to the PTC element. For comparison, a Comparative PTC Device 3 was produced as Comparative Example 3 by using a solder paste instead of the electrically conductive adhesive, connecting the lead to the PTC element by soldering in a reflow oven (250-260° C.). It is noted that the PTC device of the Comparative Example was subjected to the impulse treatment (current (DC16 V, 10 A) was applied for 6 seconds) and further subjected to resistance stabilization treatment (subjecting to temperature cycling between 80° C. (maintained for 1 hour) and −40° C. (maintained for 1 hour) with temperature change ratio 2° C./minute).

EXAMPLE 4

Producing PTC Device 4

Other than using TD1115-B34XA 0 PTC chip (produced by Tyco Electronics Raychem, size: 11 mm×10 mm), Example 3 was repeated. Similarly, Comparative PTC Device 4 was produced as Comparative Example 4.

EXAMPLE 5

PTC Devices 1 to 4 and Comparative PTC Devices 1 to 4 described above were evaluated. The resistance (resistance between the lead and the metal electrode to which the lead is not connected; since the resistance values of the lead and the metal electrode are far lower than the resistance of the PTC element, the resistance of the PTC device is substantially equal to the resistance of the PTC element) of the PTC devices obtained was measured. The results are shown in Table 1.

TABLE 1

(Unit: mΩ)

| | Example 1 | Example 2 | Example 3 | Example 4 | Comp. Example 1 | Comp. Example 2 | Comp. Example 3 | Comp. Example 4 |
|---|---|---|---|---|---|---|---|---|
| Average | 22.82 | 8.04 | 21.24 | 31.0 | 33.92 | 15.82 | 32.86 | 48.96 |
| Minimum | 21.9 | 7.6 | 21.0 | 30.4 | 32.6 | 15.0 | 32.1 | 48.1 |
| Maximum | 23.6 | 8.5 | 21.7 | 31.5 | 37.6 | 16.6 | 34.2 | 50.2 |
| Standard Deviation | 0.506 | 0.178 | 0.250 | 0.415 | 1.52 | 0.399 | 0.712 | 0.728 |

As is clear from the results, the resistance of the PTC element is decreased in the PTC device according to the present invention. Further, the variation in the resistance is smaller.

EXAMPLE 6

Measurement of Resistance-Temperature Characteristics

Figure 2:
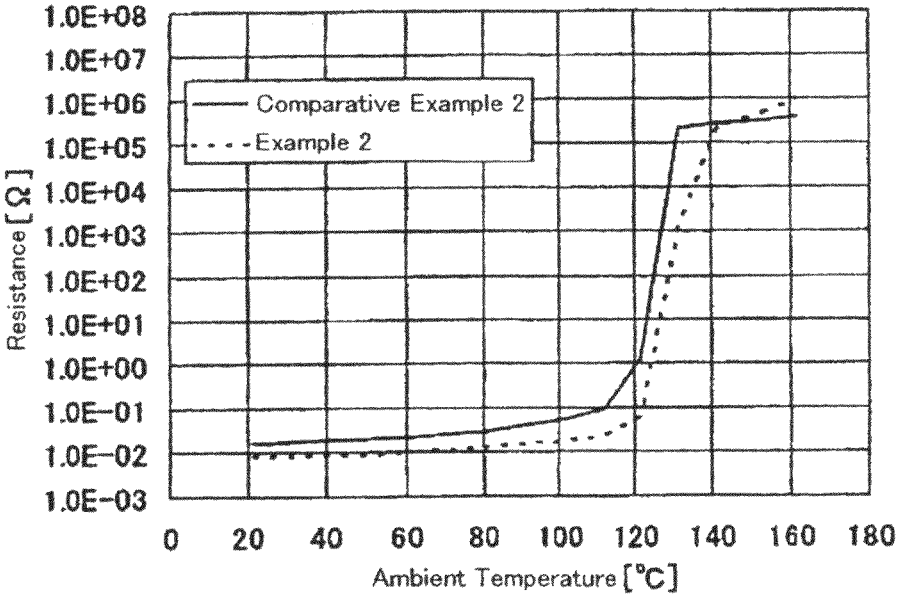
FIG. 2 is a graph showing measurement results of resistance-temperature characteristics of the PTC devices of Example 2 and Comparative Example 2'
Figure 3:
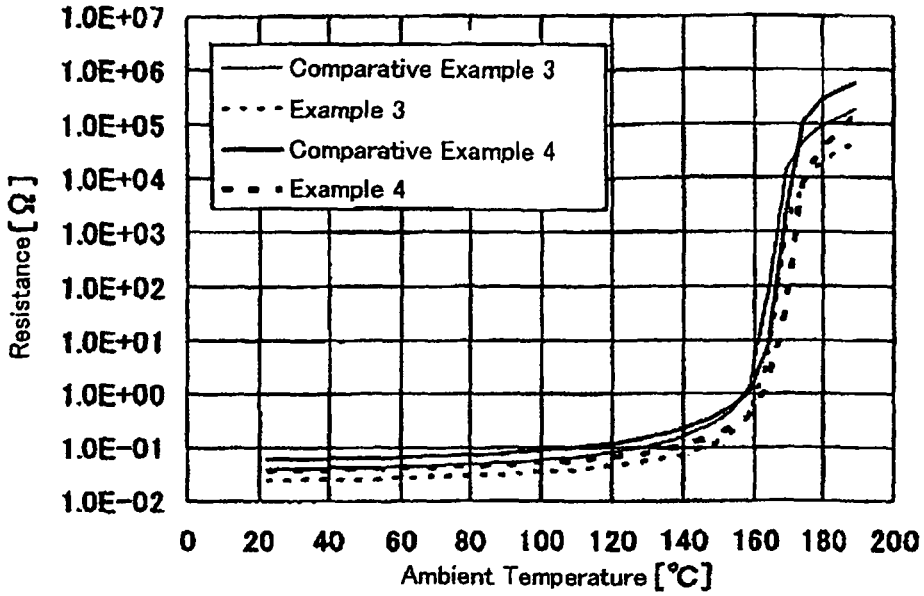
FIG. 3 is a graph showing measurement results of resistance-temperature characteristics of the PTC devices of Examples 3 and 4 and Comparative Examples 3 and 4.

The temperature-resistance characteristics of the PTC devices in Examples 2 to 4 and the PTC devices in Comparative Examples 2 to 4 were measured. The test temperature range was 20° C. to 150° C., and the atmosphere humidity around the PTC devices was 60% or less. The atmosphere temperature around the PTC devices was increased by increments of 10° C. and each atmosphere temperature was maintained for 10 minutes, after which the resistance of the PTC devices was measured. As to the PTC devices in the Comparative Examples, measurement was similarly carried out. The results are shown in FIGS. 2 and 3. It can be seen that every PTC device exhibited the PTC function essentially required, i.e. a rapid increase in resistance at a threshold temperature.

As is clear from FIGS. 2 and 3, the resistance rise when the atmosphere temperature around the device is increased is steeper in the PTC devices produced in accordance with the process of the present invention. This shows that the PTC element in the PTC device of the present invention has the characteristic of maintaining a relatively lower resistance before tripping and increasing the resistance rapidly when tripped; such a characteristic is desirable in the PTC device. Although not shown, similar results were obtained in the PTC device in Example 1 and the PTC device in Comparative Example 1.

EXAMPLE 7

Trip Cycle Test

A trip cycle test was performed on the PTC device in Example 2 and the PTC device in Comparative Example 2. In other words, the PTC device was tripped by applying DC 16 V/50 A (for 6 seconds) at room temperature, after which current was cut off for 54 seconds to reset the device; current was turned on under the same conditions for 6 seconds again to trip the device (i.e. activate the device), then the device was reset by turning off the current for 54 seconds. The change in resistance depending on the number of current ON/OFF cycles was observed. The results are shown in Table 2.

TABLE 2

(Unit: mΩ)

| | No. of Cycles | | | | | |
|---|---|---|---|---|---|---|
| | 0*) | 1 | 10 | 100 | 500 | 1000 |
| Example 2 | 8.10 | 9.65 | 9.85 | 9.70 | 9.65 | 9.85 |
| Comparative Example 2 | 16.2 | 21.3 | 20.3 | 18.7 | 17.8 | 17.9 |

*)Reference resistance: resistance of PTC device before tripping

Figure 4:
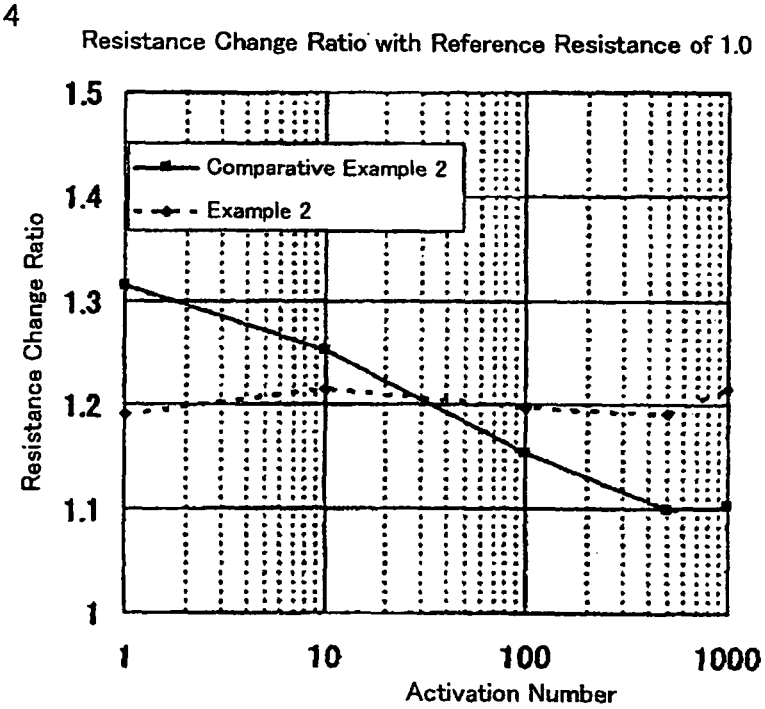
FIG. 4 is a graph showing measurement results of trip cycle test on the PTC devices of Examples 3 and 4 and Comparative Examples 3 and 4.

Further, FIG. 4 shows a ratio to the resistance at zero cycle, i.e. assuming the reference resistance to be 1, the ratio of the resistance after completion of each cycle, in other words the ratio of resistance change with regard to the number of cycles (therefore, the number of activations).

In addition, it is known that, with respect to the PTC devices, the resistance generally increases the most at the initial trip. With the device in Example 2, the resistance after the initial trip was approximately 1.19 times (9.65/8.10), whereas with the device in Comparative Example 2, the resistance was approximately 1.32 times; from which point also, the PTC device in Example 2 is preferred.

EXAMPLE 8

Simulation of PTC Device Production

Generally, in the production process of the PTC device, an impulse treatment described below and the thermal stabilization treatment (two types of thermal cycling treatments described below) are performed after attaching the lead. Therefore, this production process was simulated so as to produce a PTC device by performing the predetermined steps in sequence, and thereafter, the PTC device was tripped. During such procedure, the following resistance values were measured in sequence.

Resistances of the PTC elements used in Examples 3 and 4 (indicated as "Chip" on the graph)

Resistances of the PTC devices produced in Examples 3 and 4 made by attaching the leads to the such PTC elements (indicated as "Assy" on the graph)

Resistances of such PTC device after applying DC25 V/40 A for 6 seconds (i.e. resistances after the impulse treatment) (indicated as "Impulse" on the graph)

Resistances after the heat cycle treatment between 160° C. (held for 1 hour) and 0° C. (held for 1 hour) (temperature change rate 2° C./minute) (indicated as "160<==>0° C." on the graph)

Resistances after the heat cycle treatment between 80° C. (held for 1 hour) and −40° C. (held for 1 hour) (temperature change rate 2° C./minute) (indicated as "80<==>−40° C." on the graph)

Resistances after the PTC devices are tripped (indicated as "Trip" on the graph)

Figure 5:
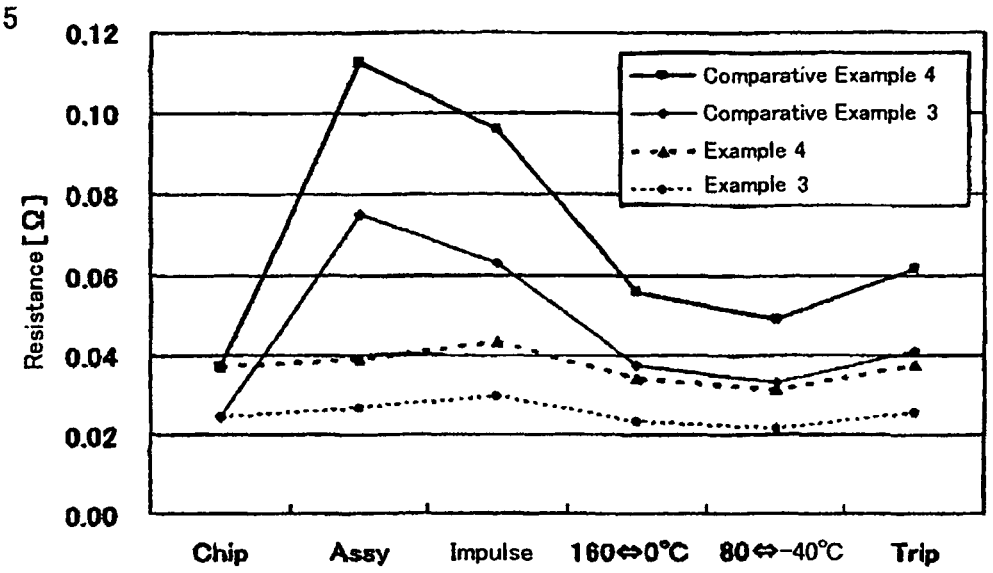
FIG. 5 is a graph showing resistance changes in the PTC devices when the producing processes of the PTC devices of Examples 3 and 4 and Comparative are simulated.

Further, for comparison, the above resistance values were measured on embodiments wherein the lead is connected by soldering (reflow furnace temperature of 250 to 260° C.) as in Comparative Examples 3 and 4 (i.e. the conventional PTC device production process). Those results are shown the graph of FIG. 5.

As is clear from FIG. 4, when attaching the lead with the electrically conductive adhesive in accordance with the present invention, the resistance values of the PTC device do not change greatly from the resistance of the original PTC element during the process of producing the PTC device from the PTC element. In contrast, when attaching the lead by soldering, it is seen that the resistance increases greatly when the lead is attached, while the resistance of the PTC device decreases and stabilizes through the impulse treatment and the thermal stabilization treatment thereafter.

Thus, when producing the PTC device in accordance with the present invention, the resistance will not increase even when the lead is attached, so that at least one of the impulse treatment and the thermal stabilization treatment that are required in the conventional process of producing the PTC devices, and preferably both, may be omitted.

To make sure, the bondability between the lead and the metal electrode of the PTC devices in Examples 1, 2 and 4 was checked by measuring peel strength. The peel strength measurement was performed by fixing the PTC device and clasping the corner part of the lead of the PTC device with a clamp and pulling the lead up, and measuring the tensile force required to peel the lead off. The results are shown in Table 3.

TABLE 3

| PTC Device | Example 1 | Example 2 | Example 4 |
|---|---|---|---|
| Tensile Force (kgf) | 1.17 | 3.58 | 3.31 |

These results show that in every PTC device, the bondability of the lead presents no problem in using the PTC device.

Further, a free-fall test in accordance with JIS C 0044 (IEC68-22) was performed to verify whether or not the lead got detached. None of the PTC devices in the Examples showed detachment. Also, in accordance with the terminal strength test of JIS C 0051, displacement of the lead was checked to observe any abnormality in the external appearance after applying a force of 40 N±10% tensile force for 10 seconds±1 second on the corner part of the lead. All the PTC devices in the Examples passed the test based on such terminal strength test of the JIS without abnormality in the external appearance of the device.

The present invention allows the production of a PTC device having a low resistance, and allows the conventionally required resistance stabilization treatment to be omitted. In other words, once a lead is attached to the PTC element, it may be used as a PTC device without performing any special treatment thereafter.

The invention claimed is:

1. A process of producing a PTC device which comprises providing a PTC element having a polymer PTC component and metal electrodes placed on both sides thereto, the PTC component being formed of an electrically conductive polymer composition comprising a polymer material having a melting point and a conductive filler dispersed therein; and electrically connecting a lead to at least one of the metal electrodes-at a temperature which is lower than the melting point of the polymer material, the connection of the lead to the metal electrode being performed by an electrically conductive adhesive placed between the lead and the metal electrode, the electrically conductive adhesive comprising a thermosetting resin having a curing temperature lower than the melting point of the polymer material, and the lead being connected to the metal electrode by heating the conductive adhesive placed between the lead and the metal electrode so as to cure the thermosetting resin, the curing temperature of the thermosetting resin being at least 20° C. lower than the melting point of the polymer material.

2. The process according to claim 1, wherein the curing temperature of the thermosetting resin is at least 30° C. lower than the melting point of the polymer material.

3. The process according to claim 1, wherein the polymer material is a high density polyethylene, and the electrically conductive adhesive comprises an epoxy resin.

4. The process according to claim 1, wherein the polymer material is a polyvinylidene fluoride, and the electrically conductive adhesive comprises an epoxy resin.

5. The process according to claim 1, wherein the PTC device is obtained as a product by completing the connection of the lead to the metal electrode.

* * * * *